US006206081B1

(12) United States Patent
Chiang et al.

(10) Patent No.: US 6,206,081 B1
(45) Date of Patent: Mar. 27, 2001

(54) WITHDRAWAL ELEVATOR MECHANISM FOR WITHDRAWAL FURNACE WITH A CENTER COOLING SPOOL TO PRODUCE DS/SC TURBINE AIRFOILS

(75) Inventors: Feng Chiang, Palm Harbor; Omer Carl Peterson, Lutz, both of FL (US)

(73) Assignee: Chromalloy Gas Turbine Corporation, San Antonio, TX (US)

( * ) Notice: Subject to any disclaimer, the term of this patent is extended or adjusted under 35 U.S.C. 154(b) by 0 days.

(21) Appl. No.: 09/304,977

(22) Filed: May 4, 1999

(51) Int. Cl.[7] ..... B22D 27/04
(52) U.S. Cl. ..... 164/338.1; 164/350; 164/352
(58) Field of Search ..... 164/338.1, 122.1, 164/122.2, 125, 127, 350, 352

(56) References Cited

U.S. PATENT DOCUMENTS

| | | | |
|---|---|---|---|
| 3,810,504 | 5/1974 | Piwonka | 164/60 |
| 3,897,815 | 8/1975 | Smashey | 164/127 |
| 4,178,986 | 12/1979 | Smashey | 164/251 |
| 4,969,501 | 11/1990 | Brokloff et al. | 164/122 |
| 5,778,961 | 7/1998 | Hugo et al. | 164/122.1 |
| 5,931,214 * | 8/1999 | Spicer et al. | 164/338.1 |

* cited by examiner

*Primary Examiner*—Harold Pyon
*Assistant Examiner*—I.-H. Lin
(74) *Attorney, Agent, or Firm*—Mitchell D. Bittman; Robert C. Faber

(57) ABSTRACT

A casting apparatus includes a substantially stationary heating chamber having an upper pouring opening and a substantially open lower end; an outer cooling spool disposed at a periphery of the open lower end of the heating chamber; a chill plate having an aperture therethrough and movable through the lower end of the heating chamber; a mold assembly receivable in the chamber and movable through the lower end of the chamber and including peripherally disposed mold cavities defining a substantially interior space accessible through the open lower end of the chamber, an inner cooling spool movable through the aperture of the chill plate and the open lower end of the mold assembly; a first actuator for vertically displacing the chill plate and mold assembly; and a second actuator for vertically displacing the inner cooling spool.

38 Claims, 5 Drawing Sheets

WITHDRAWAL ELEVATOR MECHANISM FOR WITHDRAWAL FURNACE WITH A CENTER COOLING SPOOL TO PRODUCE DS/SC TURBINE AIRFOILS

BACKGROUND OF THE INVENTION

1. Field of the Invention

The present invention relates to an apparatus for solidifying a casting to create a directionally solidified or single crystal casting and, more particularly, to an apparatus which is capable of introducing a cooling spool into a casting mold and withdrawing the casting mold from a stationary heating chamber.

2. Related Art

Solidifying molten materials, such as molten metal, in a mold cavity to create a directionally solidified or single crystal casting is known. FIGS. 1*a* and 1*b* illustrate a conventional apparatus 10 for producing a casting. An example of this is disclosed in U.S. Pat. No. 4,969,501. The apparatus 10 includes a heating chamber 12 defining an interior volume 16 which is heated via heating elements 14. A plurality of casting molds 20 are disposed in an annular array on a vertically movable chill plate 22. The molds are supported in and removable from the interior volume 16 by the movable plate 22. The movable plate 22 is vertically displaced by column 24. More particularly, the casting molds 20 may be removed from the interior volume 16 by displacing the plate 22 in the direction of arrow A (FIG. 1*b*) while the heating chamber 12 remains stationary.

Unfortunately, apparatus 10 produces directionally solidified or single crystal castings having less desirable material properties due to a lower thermal gradient during casting. A thermal baffle or heat sink is not introduced into an interior region of the casting mold apparatus during the withdrawal from the heating chamber 12 to selectively absorb radiant heat being supplied from the molds 20. Indeed, order to obtain a directionally solidified or single crystal casting, a casting mold must be removed from a heating chamber using special procedures.

FIGS. 2*a* and 2*b* show another conventional apparatus 50 to produce a directionally solidified or single crystal casting. An example of this is disclosed in U.S. Pat. No. 5,778,961. The apparatus 50 includes a heating chamber 12 defining an interior volume 16 for receiving an annular array of casting molds 20. The casting molds 20 surround and define an interior space 21. The molds are disposed on a chill plate or disk 30 which includes a central aperture 31. A thermal baffle or heat sink 34 is shaped and sized to pass through the aperture 31 in the plate 30, and the baffle is movable vertically upward in the direction of arrow C (FIG. 2*b*) with respect to the plate 30 by its supporting column 36. In particular, the thermal baffle 34 may be moved into the interior space 21 by moving the column 36 upward, and vice versa. The radiation baffle 19 is disposed below the open end of the heating chamber 12.

The casting molds 20 are maintained in a substantially fixed position and height with respect to a floor 32. The casting molds 20 are removed from the interior volume 16 of the heating chamber 12 by raising the heating chamber 12 in the direction of arrow B (FIG. 2*b*). Thermal baffle 34 may be moved into interior space 21 while the heating chamber 12 is moved.

Apparatus 50 is also less desirable for preparing directionally solidified or single crystal castings because the heating chamber 12 must be lifted away from the casting molds 20 while the molds 20 are fixed in height and position with respect to floor 32 which is contrary to industry practice. The investment casting industry more widely accepts withdrawal processes in which the casting molds 20 are moved downward out of the heating chamber 12, and would be unable to retrofit existing furnaces to provide a heating chamber 12 which must be lifted.

Accordingly, there is a need in the art for a directionally solidified or single crystal casting apparatus which allows for withdrawing casting molds from a substantially fixed heating chamber.

SUMMARY OF THE INVENTION

In order to overcome the disadvantages of the prior art, the casting apparatus of the present invention includes a substantially stationary heating chamber having an upper pouring opening and a substantially open lower end. An outer cooling spool is disposed at the periphery and the open lower end of the heating chamber. A chill plate having an aperture therethrough is movable through the lower end of the heating chamber from the lower end of the chamber to below that end.

A mold assembly is receivable into the lower end of the heating chamber. The assembly includes at least one, and typically includes an annular array of a plurality of peripherally disposed mold cavities disposed on the chill plate.

An inner cooling spool is movable through the aperture of the chill plate and the open lower end of the mold assembly. A first actuator vertically displaces the chill plate and the mold assembly with respect to the heating chamber. A second actuator vertically displaces the inner cooling spool with respect to the heating chamber.

Other objects, features, and advantages of the casting apparatus of the present invention will become apparent to those skilled in the art in view of the description below taken in conjunction with the accompanying drawings.

BRIEF DESCRIPTION OF THE DRAWINGS

For the purpose of illustrating the invention, there are shown in the drawing forms which are presently preferred, it being understood, however, that the invention is not limited to the precise arrangements and instrumentalities shown.

DESCRIPTION OF THE PREFERRED EMBODIMENTS

Figure 1A:
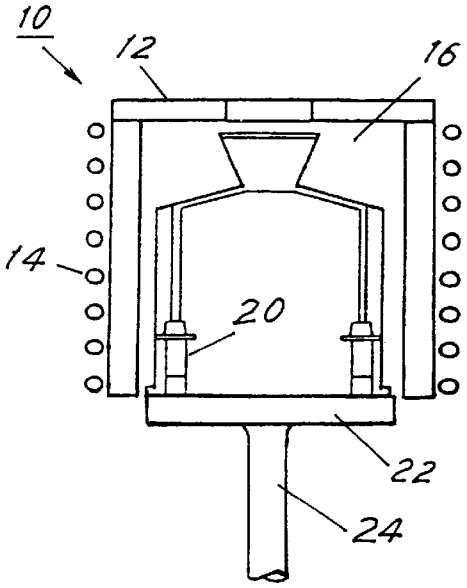
FIG. 1a PRIOR ART
FIG. 1*a* is a side sectional view of a casting apparatus according to one embodiment of the prior art.
Figure 1B:
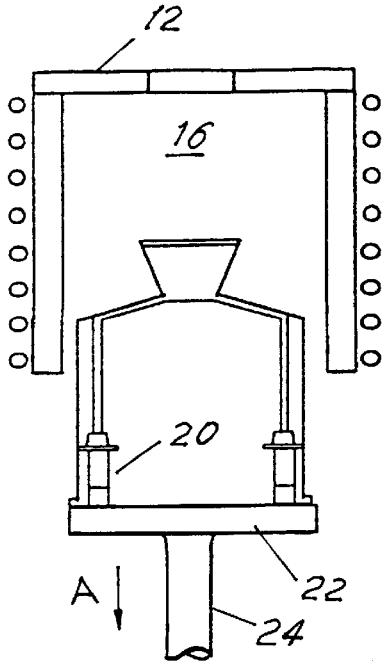
FIG. 1b PRIOR ART
FIG. 1*b* is a side sectional view of the casting apparatus of FIG. 1*a* where casting molds are being withdrawn.
Figure 2A:
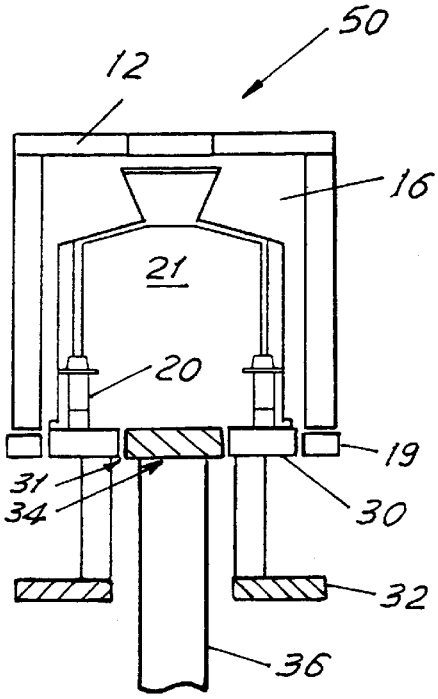
FIG. 2a PRIOR ART
FIG. 2*a* is a side sectional view of a casting apparatus according to another embodiment of the prior art.
Figure 2B:
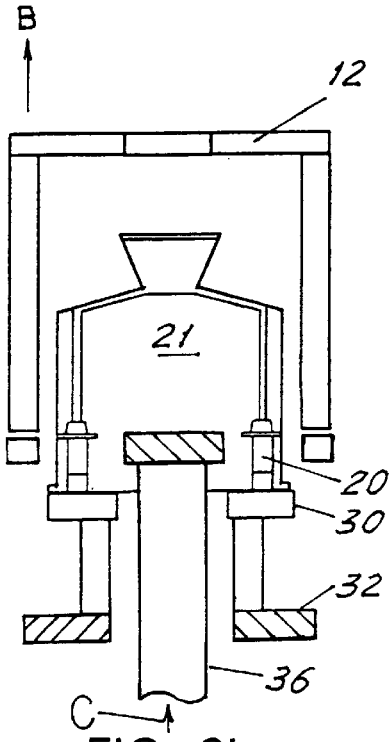
FIG. 2b PRIOR ART
FIG. 2*b* is a side sectional view of the casting apparatus of FIG. 2*a* where its heating chamber is being removed.
Figure 3:
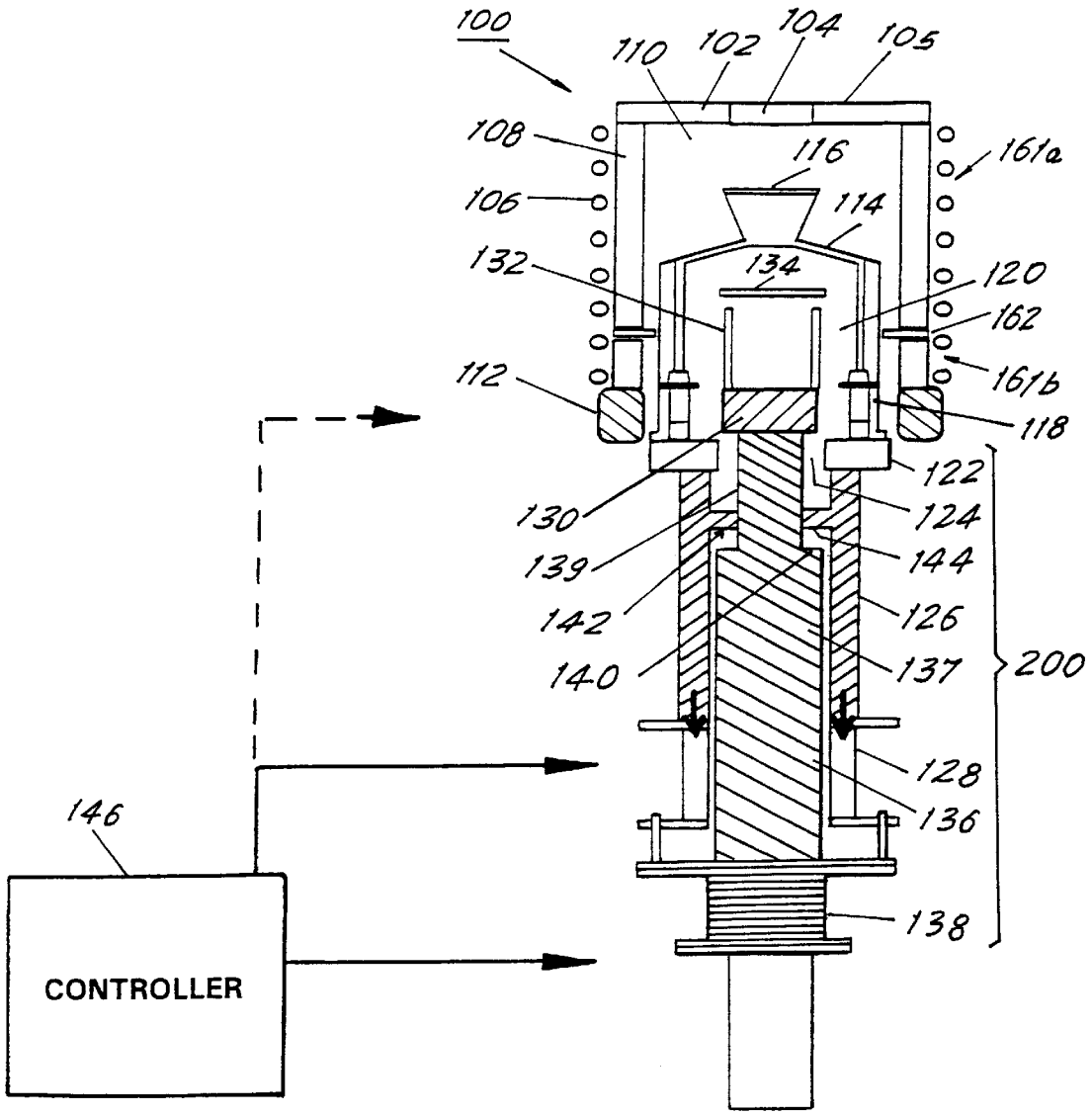
FIG. 3 is a side sectional view of a casting apparatus according to the present invention.

Referring to the drawings, FIG. 3 shows an elevational sectional view of a casting apparatus 100 according to a first embodiment of the present invention. The casting apparatus 100 includes a substantially stationary heating chamber (or susceptor when inductor coils are used as the mold heater 106) 102 having a pouring opening 104 through hood 105 for receiving moldable liquid (molten metal), located at its top end, and an open lower end spaced below the pouring opening 104. The heating chamber 102 includes a mold heater 106, preferably formed by electric induction coils wrapped around walls 108 of the heating chamber (susceptor) 102. Preferably, the heating chamber 102 is in the form of a cylinder having an interior volume 110 accessible through the open lower end and heated by the mold heater 106, typically induction coils or resistance heaters. The heating chamber 102 is divided into two heating zones 161*a* and 161*b* separated by baffle 162.

An outer cooling spool 112 is disposed about and just below the periphery of the open lower end of the heating chamber 102. The outer cooling spool is substantially ring-shaped so that the open lower end of the heating chamber 102 is not obstructed. The outer cooling spool 112 is capable of absorbing radiant heat. The outer cooling spool 112 is preferably formed from a fast thermal conductivity material such as a copper and/or steel material and is internally water cooled. The casting apparatus 100 also includes mold apparatus (casting mold) 114 which includes an annular array of a plurality of mold cavities 118, as is known in art. In one preferred application, each of the mold cavities is shaped to form a turbine airfoil for an aircraft engine. The annular mold apparatus 114 defines an interior space 120 accessible through the open lower end of the chamber 102. The mold apparatus 114 includes a pouring basin 116 which receives the moldable material (molten metal) and communicates (connects) with the mold cavities 118.

The heating chamber 102 and the mold apparatus 114 are sized and shaped such that the mold apparatus 114 may be received within the interior volume 110 of the heating chamber 102. The heating chamber 102 remains substantially stationary while the mold apparatus 114 is movable vertically into and out of the interior volume 110 and through the open lower end of the heating chamber 102 by an elevator mechanism 200.

The elevator mechanism 200 includes a chill plate 122 which is movable with respect to the substantially open, stationary lower end of the heating chamber 102. The chill plate 122 is annular to support the annular mold apparatus 114. In particular, the chill plate 122 includes a central aperture 124 which communicates with the substantially open lower end of the mold apparatus 114 such that the interior space 120 of the mold apparatus 114 is accessible through the aperture 124. The chill plate 122 is sized and shaped such that it may be received into, and is coaxial with respect to, at least one of the outer cooling spool 112 and the open lower end of the heating chamber 102. It is preferred that the chill plate is made of a fast thermal conducting material such as copper and/or steel and is internally water cooled, the water being provided through column 126.

The elevator mechanism 200 also includes a column 126 coupled at its top end to the lower surface of the chill plate 122 and at an opposite bottom end to a first actuator 128. The actuator 128 may be a hydraulic, pneumatic, and/or other mechanical lifter which is capable of vertically displacing the column 126, the chill plate 122 on the column 126, and the mold apparatus 114 on the chill plate with respect to the fixed height heating chamber 102. The column 126 is preferably substantially cylindrically shaped and defines a hollow interior region.

The elevator mechanism 200 supports an inner cooling spool 130 that is movable through the aperture 124 in the chill plate 122 and into and out of the interior space 120 of the mold apparatus 114. The inner cooling spool 130 is preferably substantially disk shaped. It is capable of absorbing radiant heat from the interior space 120 of the mold apparatus 114. It is preferred that the inner cooling spool 130 be formed from a fast thermal conductive material such as copper and/or steel and be internally water cooled, the water being provided through the inner column 136.

An upstanding, annular, cylindrical reflective shield 132 is disposed atop the inner cooling spool 130. The exterior of the reflective shield 132 provides a reflective surface that is directed substantially toward the mold apparatus 114 and reflects radiant heat energy back toward the mold apparatus 114. The reflective shield 132 includes a monolithic refractory material to form the reflective surface, such as high purity alumina or zirconia, although other similarly functioning materials may be employed for the invention. The reflective shield 132 may be formed in segments to obtain, for example, a 360° cylindrical reflective shield substantially facing the mold apparatus 114. The reflective shield 132 may include a cap 134 at its top end. The reflective shield 132 is relatively movable with respect to the interior region 120 of the mold apparatus 114 by movement of the inner cooling spool 130. A second column 136 inside the first outer column 126 has its top end coupled to the lower surface of the inner cooling spool 130 and has its opposite bottom end coupled to a second actuator 138 (such as a hydraulic, pneumatic, and/or other mechanical lifting device). The actuator 138 displaces the column 136, the inner cooling spool 130, and the reflective shield 132 together and with respect to the mold apparatus 114 and the heating chamber 102. The column 136 is disposed coaxially within the substantially hollow cylindrical first column 126.

First actuator 128 is coupled to second actuator 138 and, in particular, actuator 128 is disposed above actuator 138. The first actuator 128 vertically displaces column 126, chill plate 122, and mold apparatus 114 over a distance defined by the lengths of columns 126 and 136. The second actuator 138 vertically displaces all of first column 136, inner cooling spool 130, reflective shield 132, column 126, chill plate 122, and mold apparatus 114.

Inner second column 136 includes a lower section 137 having a larger diameter and an upper section 139 having a smaller diameter and is shaped to define a shoulder 140 at the periphery of the column 136 between the sections 137 and 139. The column 126 includes a radially inwardly directed ring 142 extending from the inner surface of column 126 toward the upper section 139 of column 136 defining a seat 144 in the column 126 which is opposed to the shoulder 140. Shoulder 140 and seat 144 may be moved into and out of engagement by actuators 128 and 138.

The elevator mechanism 200 includes a controller 146 (such as an electronic microprocessor under software control) which provides commands to actuator 128, actuator 138, and/or other structures of the casting apparatus 100 (such as temperature sensing devices, position sensing devices, other actuators, etc.).

To obtain directionally solidified or single crystal castings, it is important, among other things, to control temperature gradients at the mold cavities 118 as the mold apparatus 114 is removed from the heating chamber 102 and while the castings cool.

The outer cooling spool 112 serves as a heat sink to absorb radiant heat from the mold apparatus 114 which has been preheated in the heating chamber 102. In particular, the outer cooling spool 112 absorbs the radiant heat from below the heating chamber 102 such that molten metal within the mold apparatus 114 is solidified directionally by a thermal gradient defined from the heating chamber 102 to the outer cooling spool 112. The thermal gradient is a function of the temperature difference between the heating chamber 102 and the outer cooling spool 112. Therefore, the higher the temperature of the heating chamber 102, the greater the magnitude of heat that the outer cooling spool 112 can absorb, thus higher thermal gradients are obtained.

Further control of the temperature gradient is provided by the movable inner cooling spool, the reflective shield 132, and the movable mold apparatus 114, as described below.

Figure 4C:
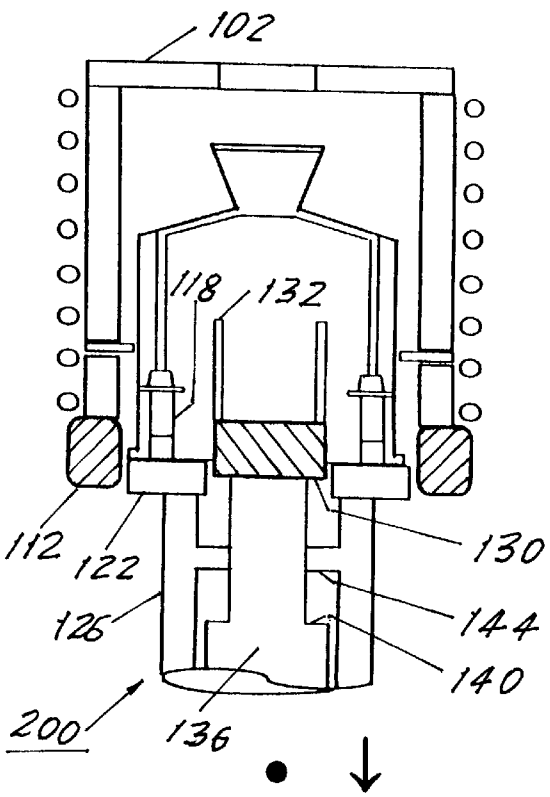
FIGS. 4*a*–4*f* are side sectional views of the casting apparatus of FIG. 3 with casting molds in various stages of withdrawal.
Figure 4B:
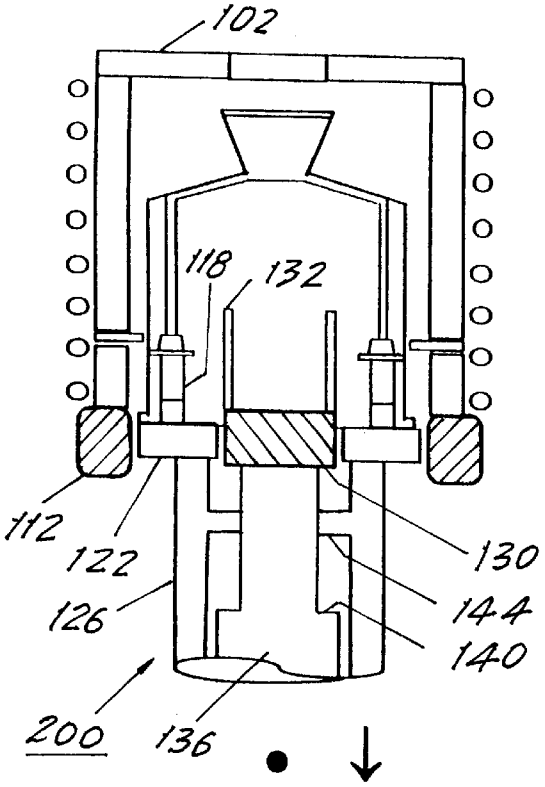
Figure 4A:
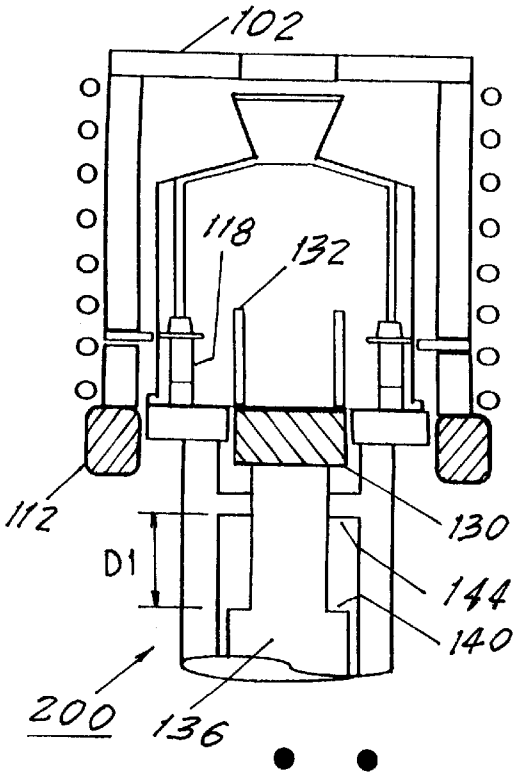
Figures 4D, 4E, 4F:
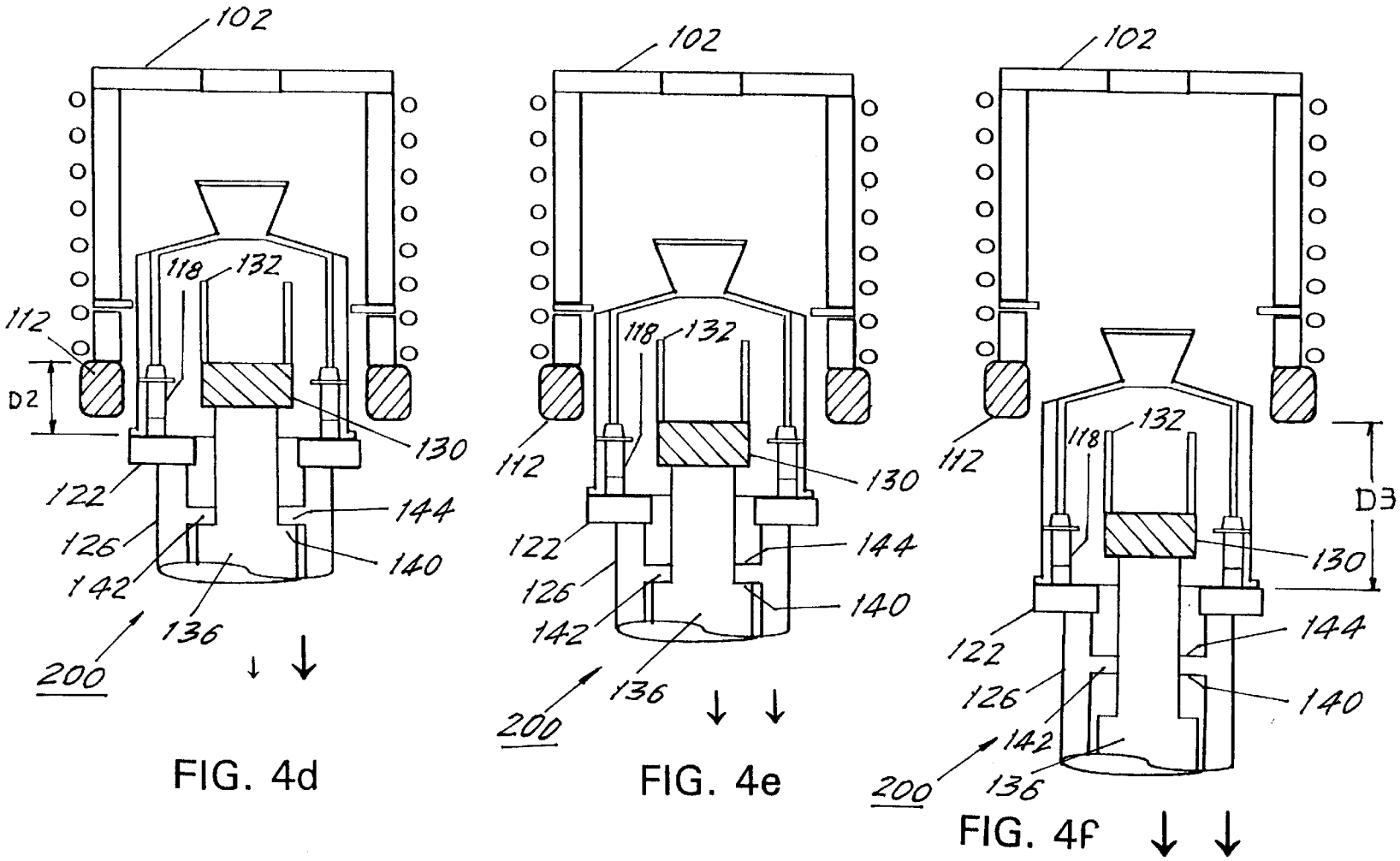

Operation of the casting apparatus 100 of the present invention is described with reference to FIGS. 4*a*–4*f*. FIG. 4*a* shows the relative positions of chill plate 122, mold apparatus 114, inner cooling spool 130, and reflective shield 132 with respect to heating chamber 102 and outer cooling spool 112 just prior to the withdrawal of the mold apparatus 114 from the heating chamber 102. Both actuators 128, 138 (not shown in FIG. 4*a*) are biased upward such that the inner cooling spool 130, chill plate 122, and outer cooling spool 112 are all substantially planar, with the reflective shield 132, mold apparatus 114, and heating chamber 102 above them. Inner cooling spool 130 is substantially at the same height as and coplanar with the outer cooling spool 112. FIGS. 4*b*–4*d* illustrate a first period of withdrawal of the mold apparatus 114 from the heating chamber 102. The arrows and dots below FIGS. 4*a*–4*f* show the stationary position and descent of the indicated columns 126, 136. Starting in the position in FIG. 4a, actuator 128 causes first outer column 126 to displace the chill plate 122 and mold apparatus 114 downward away from the substantially stationary heating chamber 102 through the position shown in FIG. 4*b*, through that shown in FIG. 4*c* to that shown in FIG. 4*d*. Meanwhile, actuator 138 holds column 136 substantially stationary such that the relative positions of the inner and outer cooling spools 130, 112 remain substantially fixed. Descent of the mold apparatus causes the inner cooling spool 130 and reflective shield 132 to enter further into the interior space 120 of the mold apparatus 114. In one alternative embodiment, reflective shield 132 can be a heating element.

As shown in FIG. 4*d*, the mold apparatus 114 is withdrawn from the interior volume 110 of the heating chamber 102 by a distance D1 during a first period. With D2 being the height of mold cavity 118, distant D1 is equal to or greater than D2. In FIG. 4*d*, at the end of the first period of withdrawal of the mold apparatus 114, the shoulder 140 of column 136 engages the seat 144 of ring 142. Thus, when the mold apparatus 114 has withdrawn a distance D1 from the heating chamber 102, the shoulder 140 of column 136 provides a stop for first column 126 and defines the end of the first withdrawal period.

FIGS. 4*e* and 4*f* illustrate the withdrawal of the mold apparatus 114 from the heating chamber 102 during a second period. Actuator 138 (as shown in FIG. 3) causes column 136 to move vertically downward with respect to stationary heating chamber 102 such that the inner cooling spool 130, reflective shield 132, chill plate 122, and mold apparatus 114 all move vertically downward and away from the substantially stationary heating chamber 102. In FIG. 4*f*, the inner cooling spool 130 moves a distance D2 with respect to the outer cooling spool 112 during the second period. Once the mold apparatus 114 has cleared the inner volume 110 of the heating chamber 102, further cooling steps which are known in the art may be performed.

Advantageously, the elevator mechanism 200 of the present invention, permits desirable temperature gradients to be obtained while the mold apparatus 114 is withdrawn from the heating chamber 102 without requiring that the heating chamber 102 be moved. This allows for existing furnaces to be retrofitted providing for a heating chamber 102 which remains stationary while the mold apparatus 114 is withdrawn from the interior volume 110.

Figure 5:
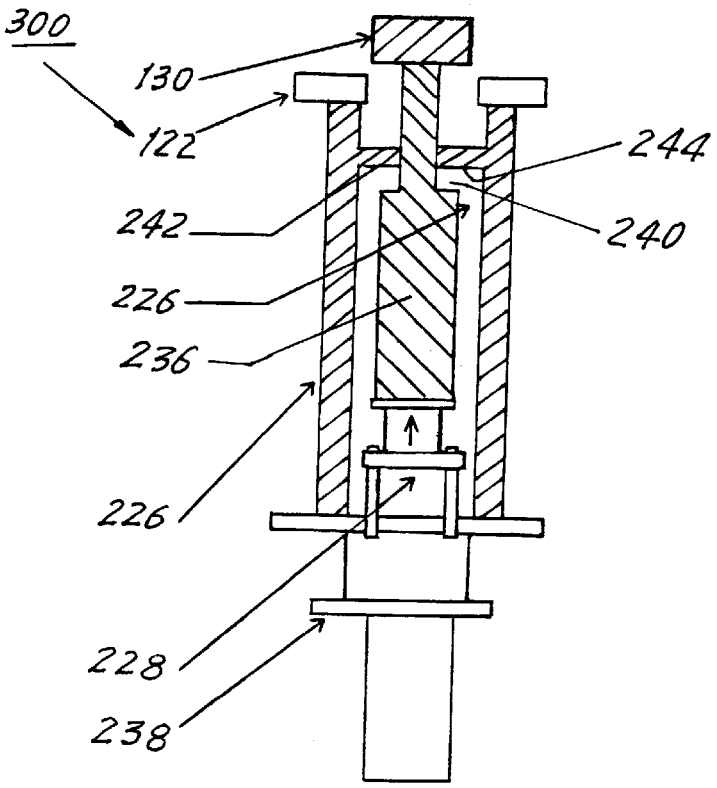
FIG. 5 is a side sectional view of an alternate embodiment of the present invention.

FIG. 5 shows an alternate embodiment of the elevator mechanism 300 of the present invention. In this embodiment, the first actuator 228 is disposed in the hollow of column 226 rather than outside the column and the first actuator moves with the second column 236. Both actuator 228 and column 226 are fixed atop the second actuator 238. To achieve the relative positions illustrated in FIGS. 4*a*–4*f*, actuator 238 causes column 226 to displace chill plate 122 vertically downward with respect to heating chamber 102 (not shown) during the first period. In order to maintain the inner cooling spool 130 substantially stationary with respect to the outer cooling spool 112 (not shown) during this first period, actuator 228 causes second column 236 to move vertically upward with respect to actuator 238 and column 226 at substantially the same rate that actuator 238 causes first column 226 to move downward. The inner cooling spool 130 remains substantially level with the outer cooling spool 112 during the first period.

Once actuator 238 has moved column 226 downward the distance D1 from the substantially stationary heating chamber 102 (FIG. 4*d*), shoulder 240 of column 236 engages seat 244 of column 226 and ring 242 to halt actuator 228 moving column 136 further upward.

During the second time period, actuator 238 continues to move column 226 downward and away from heating chamber 102 a distance D3 (FIG. 4*f*) and moves actuator 228 and column 236 downward as well to facilitate removal of the mold cavity 118.

Figure 6:
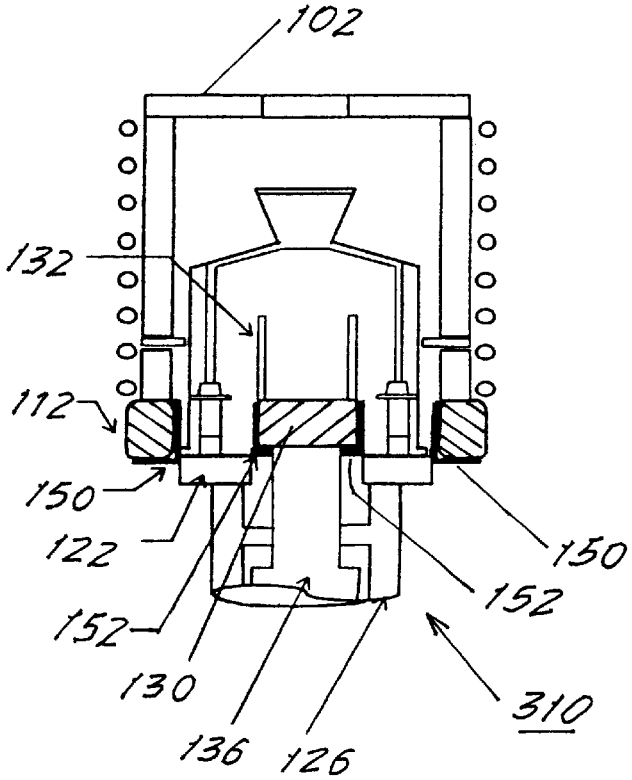
FIG. 6 is a side sectional view of yet anther embodiment of a casting apparatus according to the present invention.

FIG. 6 illustrates yet another embodiment 310 of the present invention, the remainder of which is shown in FIG. 3. Outer cooling spool 112 includes an outer spool shield 150 at its lower inner corner region. Inner cooling spool 130 includes an inner spool shield 152 around its lower periphery. The spool shields 150, 152 restrict radiant heat from passing into the respective cooling spools and reflect heat back toward the mold apparatus 114. The spool shields 150, 152 are formed from refractory materials, such as alumina, zirconia or carbon-carbon composites. The spool shields 150 and 152 are each movable vertically with respect to their respective cooling spools 112, 130 by controller 146 (FIG. 3) to adjust the height extent of the spools which is exposed to absorb radiant heat and, therefore, to control cooling. Addition details concerning spool shields 150, 152 may be found in co-pending patent application Ser. No. 09/304,994, filed May 4, 1999 entitled spool shields for producing VARIABLE THERMAL GRADIENTS IN AN INVESTMENT CASTING WITHDRAWAL FURNACE, the disclosure of which is hereby incorporated by reference.

Advantageously, spool shields 150, 152 provide additional control over the thermal gradients established during the withdrawal process. Among other things, this enables castings of differing configurations to be directionally solidified or single crystal.

The foregoing description of the preferred embodiments of the present invention has been provided for the purposes of illustration and description. It is not intended to be exhaustive or to limit the invention to the precise form disclosed. Many modifications and variations are possible in light of the above teachings. It is intended that the scope of the invention be limited not by this detailed description, but rather by the claims appended hereto.

What is claimed is:

1. A casting apparatus, comprising:

a substantially stationary, mold heating chamber having an open lower end and having a periphery;

a chill plate having a peripheral region for supporting a mold assembly comprised of casting molds on the chill plate, the chill plate having an aperture therethrough surrounded by the peripheral region, the plate being movable vertically through the lower end of the heating chamber, the plate being selectively positionable so that the casting molds on the chill plate are disposed substantially within the heating chamber and are movable to withdraw the casting molds out of the heating chamber;

an inner cooling spool shaped to be moved vertically through the aperture of the chill plate and into the heating chamber;

a first actuator for supporting and vertically displacing the chill plate and the mold assembly with respect to the heating chamber; and a second actuator for supporting and vertically displacing the inner cooling spool with respect to the heating chamber.

2. The casting apparatus of claim 1, wherein the chill plate is water cooled.

3. The casting apparatus of claim 1, wherein the heating chamber has an upper end with a pouring opening for receiving material to be molded.

4. The casting apparatus of claim 1, further comprising a mold assembly receivable in the heating chamber and being supported on the chill plate, the mold assembly including at least one peripherally disposed mold cavity supported at the chill plate.

5. The casting apparatus of claim 1, further comprising a reflective shield disposed at the inner cooling spool and inward of the mold assembly; and the shield including a surface operable to reflect heat from the heating chamber onto the mold assembly.

6. The casting apparatus of claim 5, wherein the surface includes a transversely disposed portion with respect to the inner cooling spool.

7. The casting apparatus of claim 5, wherein the surface is formed from at least one of alumina, zirconia and carbon-carbon composites.

8. The casting apparatus of claim 1, further comprising an outer cooling spool disposed at the periphery of the open lower end of the heating chamber.

9. The casting apparatus of claim 8, wherein:

when the chill plate is so positioned that the casting molds are disposed substantially within the heating chamber, the inner and outer cooling spools are in first relative positions prior to withdrawal of the mold assembly from the heating chamber;

the first actuator is operable to displace the chill plate and the mold assembly a first distance vertically downward during a first period of withdrawal of the casting molds from the heating chamber; and the second actuator is operable to maintain the inner and outer cooling spools substantially in their first relative positions during the first period of withdrawal of the mold apparatus.

10. The casting apparatus of claim 9, wherein the inner and outer cooling spools are substantially at the same height when in the first relative positions and prior to withdrawal of the casting molds from the heating chamber.

11. The casting apparatus of claim 9, wherein:

the first actuator is operable to permit the chill plate and the mold assembly to displace a second distance vertically downward during a second period of withdrawal of the mold apparatus; and the second actuator is operable to permit the inner cooling spool to displace relative to the outer cooling spool during the second period of withdrawal of the casting molds from the heating chamber.

12. The casting apparatus of claim 11, wherein the first actuator comprises a first column which is movable vertically downward with respect to the heating chamber to displace the chill plate and the mold assembly vertically downward the first distance.

13. The casting apparatus of claim 12, wherein the second actuator comprises a second column which is movable vertically downward and which supports and moves the inner cooling spool;

the second actuator causing the second column to remain substantially stationary with respect to the heating chamber to maintain the inner and outer cooling spools substantially in their first relative positions during the first period of withdrawal of the casting molds from the heating chamber.

14. The casting apparatus of claim 13, wherein the first actuator is mounted onto the second actuator.

15. The casting apparatus of claim 13, wherein the second actuator is so connected and is movable to move the second column, the first actuator, and the first column downward with respect to the heating chamber to displace the inner cooling spool relative to the outer cooling spool and to displace the chill plate and the mold assembly the second distance during the second period of withdrawal of the casting molds from the heating chamber.

16. The casting apparatus of claim 12, wherein the second actuator comprises a second column which is movable vertically;

the first actuator being operable to move the first column, the second actuator and the second column, the second actuator being operable to cause the second column to move upward with respect to the first actuator such that the inner and the outer cooling spools remain substantially in their first relative positions during the first period of withdrawal of the casting molds from the heating chamber.

17. The casting apparatus of claim 16, wherein the second actuator is mounted onto the first actuator.

18. The casting apparatus of claim 16, wherein the second actuator is operable to cause the second column to remain substantially fixed with respect to the first actuator, and the first actuator is operable to cause the first and the second columns to move downward with respect to the heating chamber to displace the inner cooling spool relative to the outer cooling spool and to displace the chill plate and the mold assembly the second distance during the second period of withdrawal of the casting molds from the heating chamber.

19. The casting apparatus of claim 11, wherein the first and second actuators include first and second columns, respectively, which are disposed coaxially.

20. The casting apparatus of claim 19, wherein the second column is disposed coaxially within the first column.

21. The casting apparatus of claim 20, wherein the first column includes a downwardly facing seat and the second column includes an upwardly facing shoulder, the seat engaging the shoulder when the first column has displaced the chill plate and the mold assembly downward the first distance.

22. The casting apparatus of claim 21, wherein the first column includes a cavity within which the second column is slidably disposed, the seat comprising an inwardly directed ring extending from an inside wall of the cavity of the first column and toward the second column.

23. The casting apparatus of claim 22, wherein the second column includes respective first and second length sections having first and second differing diameters, respectively, the shoulder being formed at a transition from the first to the second diameter of the second column.

24. The casting apparatus of claim 23, wherein the second length section of the second column passes through the inwardly directed ring.

25. A casting apparatus, comprising:

a substantially stationary, mold heating chamber having an open lower end and having a periphery;

a plate having a peripheral region for supporting a mold assembly comprised of casting molds on the plate, the plate having an aperture therethrough surrounded by the peripheral region, the plate being movable vertically through the lower end of the heating chamber, the plate being selectively positionable so that the casting molds on the plate are disposed substantially within the heating chamber and are movable to withdraw the casting molds out of the heating chamber;

an inner cooling spool shaped to be moved vertically through the aperture of the plate and into the heating chamber;

a first actuator for supporting and vertically displacing the plate and the mold assembly with respect to the heating chamber; and a second actuator for supporting and vertically displacing the inner cooling spool with respect to the heating chamber.

26. The casting apparatus of claim 25, wherein the first actuator is operable to displace the plate and mold assembly a first distance during a first interval of withdrawal of the mold apparatus; and the second actuator is operable to maintain the inner cooling spool and heating chamber in substantially fixed relative positions during the first interval of withdrawal of the mold apparatus.

27. The casting apparatus of claim 26, wherein the second actuator causes the second column to remain substantially stationary with respect to the heating chamber to maintain the inner cooling spool and heating chamber in the substantially fixed relative position during the first interval.

28. The casting apparatus of claim 26, wherein:

the first actuator is operable to permit the plate and mold assembly to displace a second distance during a second interval of withdrawal of the mold apparatus; and the second actuator is operable to displace the inner cooling spool relative to the heating chamber during the second interval of withdrawal of the mold apparatus.

29. The casting apparatus of claim 28, wherein the second actuator is operable to cause the second column, the first actuator, and the first column to move downward with respect to the heating chamber to displace the inner cooling spool relative to the heating chamber and to displace the plate and mold assembly the second distance, during the second interval of withdrawal of the mold apparatus.

30. The casting apparatus of claim 25, wherein the first actuator comprises a first column which is movable vertically downward with respect to the heating chamber to displace the plate and the mold assembly vertically downward the first distance; and the second actuator comprises a second column which is movable vertically downward and which supports and moves the inner cooling spool.

31. The casting apparatus of claim 30, wherein the second column is disposed coaxially within the first column.

32. The casting apparatus of claim 31, wherein the first column includes a seat and the second column includes a shoulder, the seat being engageable with the shoulder.

33. The casting apparatus of claim 32, wherein the first column includes a cavity within which the second column is slidably disposed, the seat being formed by an inwardly directed ring extending from an inside wall of the cavity toward the first column.

34. The casting apparatus of claim 33, wherein the second column includes first and second length portions having first and second differing diameters, respectively, the shoulder being formed at a transition from the first to the second diameter.

35. The casting apparatus of claim 34, wherein the second length portion of the second column passes through the inwardly directed ring.

36. The casting apparatus of claim 30, wherein:

the first actuator is operable to move the first column, the second actuator and the second column, the second actuator is operable to cause the second column to move upward with respect to the first actuator such that the inner spool and heating chamber remain substantially in the same relative positions during the first interval of withdrawal of the mold apparatus.

37. The casting apparatus of claim 36, wherein the second actuator is mounted onto the first actuator.

38. The casting apparatus of claim 36, wherein the second actuator is operable to cause the second column to remain substantially fixed with respect to the first actuator, and the first actuator is operable to cause the first and second columns to move downward with respect to the heating chamber to displace the inner cooling spool relative to the heating chamber and to displace the plate and mold assembly the second distance, during the second interval of withdrawal of the mold apparatus.

* * * * *